US005263743A

United States Patent [19]

Jones

[11] Patent Number: 5,263,743

[45] Date of Patent: Nov. 23, 1993

[54] PACKAGE LABEL

[75] Inventor: Donald J. Jones, Long Grove, Ill.

[73] Assignee: Pharmagraphics, Inc., Greensboro, N.C.

[21] Appl. No.: 951,211

[22] Filed: Sep. 25, 1992

[51] Int. Cl.[5] ..... B42D 15/00

[52] U.S. Cl. ..... 283/81; 283/105

[58] Field of Search ..... 283/81, 101, 103, 105, 283/106

[56] References Cited

U.S. PATENT DOCUMENTS

| | | | |
|---|---|---|---|
| Re. 30,958 | 6/1982 | White | 40/310 |
| 1,273,105 | 7/1918 | Van Duke et al. . | |
| 2,105,367 | 1/1938 | Parsons | 229/87 |
| 4,323,608 | 4/1982 | Denny et al. | 428/43 |
| 4,534,582 | 8/1985 | Howard | 283/105 |
| 4,621,837 | 11/1986 | Mack | 283/105 |
| 4,711,686 | 12/1987 | Instance | 156/227 |
| 4,726,972 | 2/1988 | Instance | 283/105 |
| 4,744,161 | 5/1988 | Instance | 40/2 R |
| 4,744,591 | 5/1988 | Instance | 281/5 |
| 4,790,563 | 12/1988 | Instance | 283/81 |
| 4,830,406 | 5/1989 | Instance | 283/81 |
| 5,031,938 | 7/1991 | Instance | 283/81 |

*Primary Examiner*—Paul A. Bell

*Attorney, Agent, or Firm*—Rhodes, Coats & Bennett

[57] ABSTRACT

A label construction formed of a first bottom panel with an adhesive backing for affixation to a pharmaceutical container, and a second series of panels in the form of a folded leaflet attached to one edge of the panel, and a third panel attached to the other edge of the bottom panel. The cover panel contains product identifying indicia on a primary portion as well as an indicated marginal area affixed to the container and separated from the primary portion by a tear line. The marginal area provides a place for the pharmaceutical or chemical manufacturer to place statutory information relating to lot number and expiration date. The leaflet formed of the second series of panels is separated from the first bottom panel by a perforated transverse fold line. The bottom panel contains substantially the same label indicia as the cover panel without the indicated area for the statutory information. The leaflet panels are folded together between the first and third panels. In use, the primary portion of the cover panel is torn away from the marginal area which remains on the container. The cover panel is also torn away from the bottom panel and discarded. The folded leaflet is torn away from the opposite edge of the bottom panel. The bottom panel and marginal edge remain on the container to identify the product and provide the statutory information.

18 Claims, 2 Drawing Sheets

PACKAGE LABEL

BACKGROUND AND SUMMARY OF THE INVENTION

The present invention is directed to a package label for pharmaceutical, agricultural, and/or chemical packages, and, more specifically, to a package label of the type which contains an identifying base label, a strip of statutory information, and folded printed literature on a removable leaflet affixed to the exterior of the package, as opposed to being placed within the package.

In the packaging of certain chemicals and pharmaceuticals, the manufacturer is often required or desires to provide a considerable amount of information concerning the chemical or pharmaceutical. In the case of pharmaceuticals, this is required by government regulations, however, the occasion may also arise, either separate from or in conjunction with government regulations, to provide the doctor, pharmacist or user with instructions on how the product should be used, what the product is, and safety precautions which should be followed in the use of the product. Sometimes the literature, which is generally in the form of folded leaflets, is placed within a box along with the container carrying the chemical or pharmaceutical (referred to as "inserts"). The placement of leaflets within the box is expensive and a cumbersome operation to perform. Also, it is difficult to insure by later inspection that the proper literature has been inserted in the proper package. Most all products are packaged in outer cartons and we are not compatible with inserts. Further, the use of folded cartons is under scrutiny by environmental groups, as involving excessive packaging. In an effort to meet this challenge, many companies are looking at ways to eliminate folding cartons that carry containers inside.

A different approach to solving this problem has developed over the last several years in which the folded literature is releasably attached to the face of the container (referred to as "outserts"), either directly to the container itself, or to a base label which, in turn, is secured to the container. The literature may then be removed by the customer. In such cases, the portion of the label remaining must carry both an "identification" of the product defined as information such as trademark, manufacturer, etc., as well as certain "statutory information" (defined as lot number and expiration date).

Thus, in order to meet the objectives of such labeling techniques, certain criteria must be met. First of all, the portion of the label which remains after the folded literature is removed must contain both the identification of the product, as well as the statutory information concerning the lot number and expiration date. Further, after the literature leaflet is assembled or affixed to the base label, the indicated area for statutory information concerning lot number and expiration date must be accessible for stamping or printing by the pharmaceutical company and visible to the consumer in addition to the identification of the product. The folded leaflet portion remains affixed to the label portion until the customer (doctor, pharmacist, consumer) desires its removal. It is critical that the proper literature must be affixed to the proper base label. Finally, all of the above criteria must be accomplished in a manufacturing technique that insures quality and is cost-effective.

Examples of types of labels in the prior art which have addressed this problem are described in U.S. Pat. No. 1,273,105 to VanDyke et al.; U.S. Pat. No. 4,621,837 to Mack; U.S. Pat. No. 4,323,608 to Denny et al.; U.S. Pat. No. 4,790,563 to Instance; U.S. Pat. No. 4,744,591 to Instance; U.S. Pat. No. 4,711,686 to Instance; U.S. Pat. No. 4,744,161 to Instance; and U.S. Pat. No. 5,031,938 to Instance. They are examples of labels which have removable portions affixed thereto. However, the aforesaid are constructed differently and operate differently than those of the instance invention.

In applicant's copending application U.S. Ser. No. 893,646 filed Jun. 4, 1992, there is disclosed a label construction whereby the separate base panel is eliminated. Rather than a multiple piece label, the base panel which carries the identifying indicia and an indicated area(s) for statutory information and the printed literature leaflet are all combined into a single unitary label. Toward this end, the label there described is formed entirely from a unitary paper blank divided into a plurality of panels defined by fold lines. A first panel (which becomes the base panel) at one end of the paper blank has a lower non-adhesive face with a prescribed printed indicia thereon and an upper face which has adhesive applied thereto. A second or front panel lies adjacent the base panel and also includes a prescribed printed indicia on the upper surface thereof adjacent the upper face of the first panel which has the adhesive substance applied thereto. A tear line extends parallel to and adjacent the fold line between the first and second panels. A third panel is provided adjacent the second panel and folded thereunder between the first and second panels. The third panel includes one or more adhesive areas (spots) adjacent to the fold line between the second and third panels for temporarily holding the free edge of the folded leaflet in place against the front surface of the base panel until the folded literature is removed. A plurality of further panels are attached to the third panel and folded together in position behind the second panel whereby the label may be applied as a unit to a product. The consumer can then separate the folded leaflet portion from the base label by tearing along the aforementioned tear line so that the leaflet is removed and the base label remains affixed to the product for identification thereof. The base panel is larger than any of the other panels and includes an indicated area(s) for the stamping of statutory information thereon concerning lot number and expiration date in addition to identifying information. This label is an excellent solution for application to flat-sided containers where the entire label is affixed to one side.

However, when used on a cylindrical package or on a rectangular package in which the label wraps around a corner, certain problems arise. Since the folded leaflet is the uppermost portion of the label, as the label is bent into a curbed configuration, the leaflet tends to pull on the adhesive bond with the base portion to the extent that the bond can be broken causing the leaflet to unravel prematurely.

This problem is addressed in the present invention by positioning the folded leaflet between a bottom panel and a cover panel having an extended flap. In this approach, there are three main components, i.e., a cover flap, a bottom panel, and a folded leaflet. The three components are initially formed integrally from a single blank and applied to the container as a unit. The cover flap includes a primary identifying portion and a marginal area carrying regulatory information affixed to the container and separated from the primary portion by a tear line. The bottom panel carries primary identification information, is affixed to the container at a point where one side is spaced from the marginal area of the cover flap, and is separated at the other side from side of the cover flap by a tear line. A folded leaflet is attached to the opposite side of the cover flap by a tear line and includes a plurality of folded pages carrying directions for use, warnings, disclaimers, and product descriptive information.

Such a label may be manufactured and applied as an integral unit to a bottle, box or other container. After purchase, the cover panel and the folded leaflet portion may be torn along the tear line and removed from the remainder of the label. Both bottom panel and the marginal portion of the cover panel remain affixed to the product for identification and providing regulatory information thereto.

It is therefore an object of the present invention to provide an improved label construction for labels of the type which include a permanent identifying portion and a removable folded leaflet portion.

It is another object of the present invention to provide an improved label of the type described in which the permanent identification label, the regulatory strip, a cover identification panel, and a folded literature portion are fabricated integrally, applied to the carton or container in one operation, then separated by the consumer.

Another object of the present invention is to provide an extended copy, pressure sensitive label which is formed integrally, carried on a web, and affixed to the package, then separated by the consumer.

Yet another object of the present invention is to provide a method for affixing labels of the type described to a silicon coated web.

Other objects and a fuller understanding of the invention will become apparent upon reading of the following detailed description of a preferred embodiment along with the accompanying drawings in which.

DETAILED DESCRIPTION OF A PREFERRED EMBODIMENT

Figure 2:
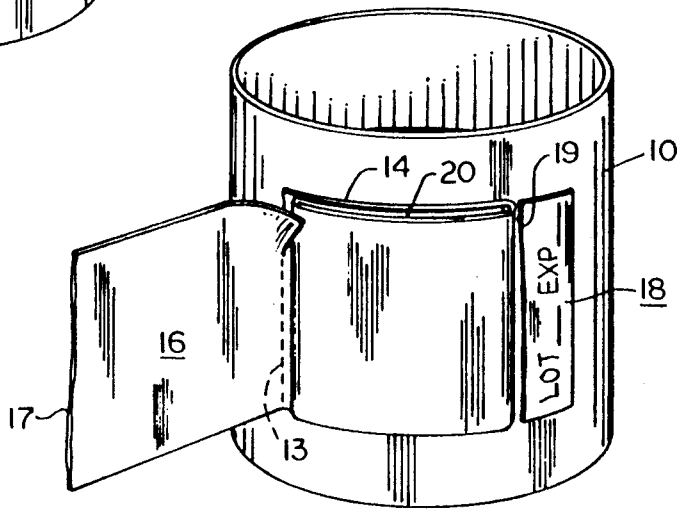
FIG. 2 is a perspective view similar to FIG. 1, except showing the container with the base portion of the label and the marginal edge area of the cover panel affixed thereto as the primary portion of the cover panel is being removed.
Figure 1:
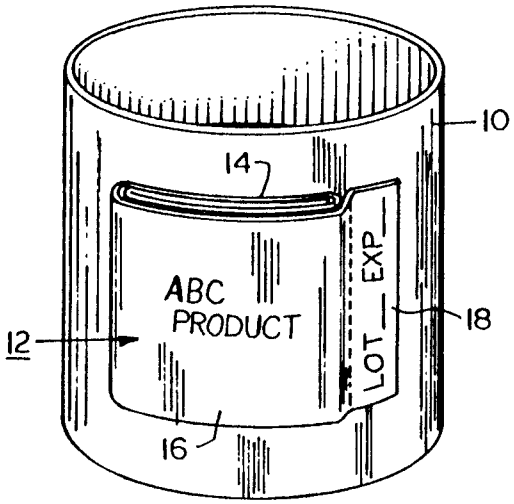
FIG. 1 is a perspective view of the label construction according to the present invention in its intended environment.

Turning now to the drawings, and referring to FIGS. 1 and 2, there is illustrated a container 10, which may be round, rectangular, or may assume any prescribed shape and be formed of any material. While container 10 may be of any prescribed shape, the present invention is particularly suitable for round or oval containers, or situations where the label will be curved or bent when emplaced as previously discussed. A label 12, as envisioned by the present invention, is affixed to the surface of the container. As has been previously described, the label 12 includes both a bottom panel 14 and a cover panel 16 having an extended flap 18. When purchased, the customer receives the container 10 with the label 12 affixed thereto as illustrated in FIG. 1. The customer then separates the primary portion of the cover panel from the marginal edge portion 18 (FIG. 2). Cover panel 16 is then removed from bottom panel 14 and discarded. The printed leaflet 20 is then removed from the bottom panel 14 for use. The bottom panel 14 carries the same identifying information as the cover panel 16 and the edge portion 18 carries the regulatory information such as lot number and expiration date. As used herein, the "customer" may be a doctor, pharmacist, or ultimate customer.

Figure 3:
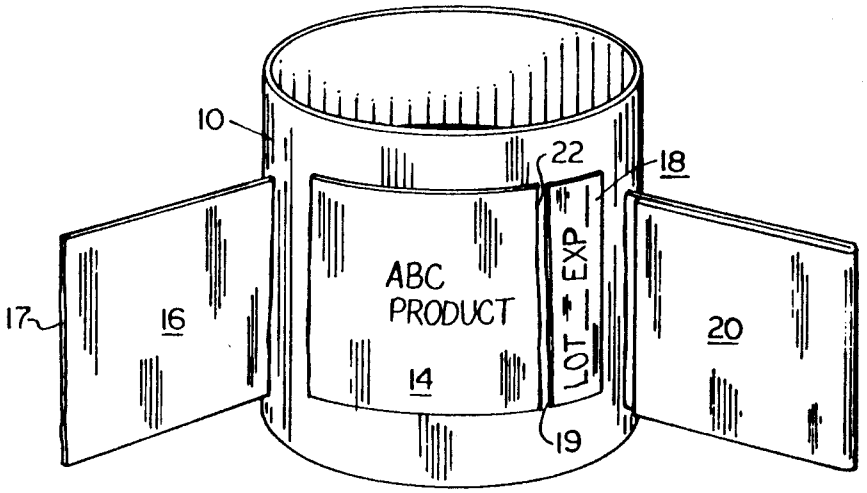
FIG. 3 is a perspective view similar to FIG. 2, except showing both the folded literature portion and the primary portion of the cover panel separated from the base of the label.

As illustrated in FIGS. 2 and 3, the leaflet is removed by first separating the right-hand edge 17 of the cover panel 16 from the left-hand edge 19 of edge portion 18 along a previously provided tear line. The cover panel 16 is removed By tearing along tear line 13, which extends along the left-hand side of the cover panel. The folded literature leaflet 20 is then separated from the right-hand edge 22 of bottom panel 14.

Once the printed leaflet 20 is removed, it is available for unfolding and reading. The remaining outer or top surface of bottom panel 14 contains identifying indicia thereon as is on the outer surface of cover panel 16. The only difference between the printed indicia on the upper surface of bottom panel 14 and on the outer surface of cover panel 16 is that the cover panel 16 also contains an extended area 18 for the placement of statutory information pertaining to lot numbers and expiration dates. This area is visible on the right-hand end of cover panel 14. After the cover panel 16 and the leaflet 20 have been removed, there remains the bottom panel 14 which serves as a permanent identifying label and the marginal edge portion which serves to carry regulatory information.

Figure 4:
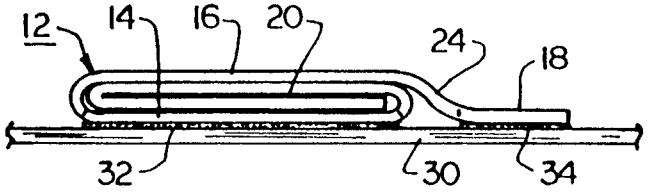
FIG. 4 is a sectional view of the label of FIG. 1 attached to a silicon coated web.

In FIG. 4, there is illustrated the label construction 12 prior to affixation to container 10. The labels 12 are preferably affixed to a web 30 of release paper (silicon treated) by separate patches 32,34 of pressure sensitive adhesive. Patch 32 temporarily affixes bottom panel 14, cover panel 14 and leaflet 20 to the silicon release paper and patch 34 temporarily affixes the marginal edge portion 18 thereto. It is important to note that there is a blank area between patches 32,34 which underlies a connecting bridge 24 of label material that extends between the primary portion of cover panel 16 and the marginal edge portion 18. The pressure sensitive adhesive patches may be applied to either the rear surfaces of label 12 or to the web 30 of release paper prior to the assembly of the labels 12 to web 12. alternatively, the labels 12 could be stored and fed separately through a suitable magazine past an adhesive applying station and directly onto the pharmaceutical or chemical package.

FIG. 4 illustrates the spiral or continuous wrap type of folding of leaflets 20. The folds forming the underneath portion of the printed leaflet may also be formed with adjacent panels folded in the opposite direction known as an "accordion" fold.

Figure 5:
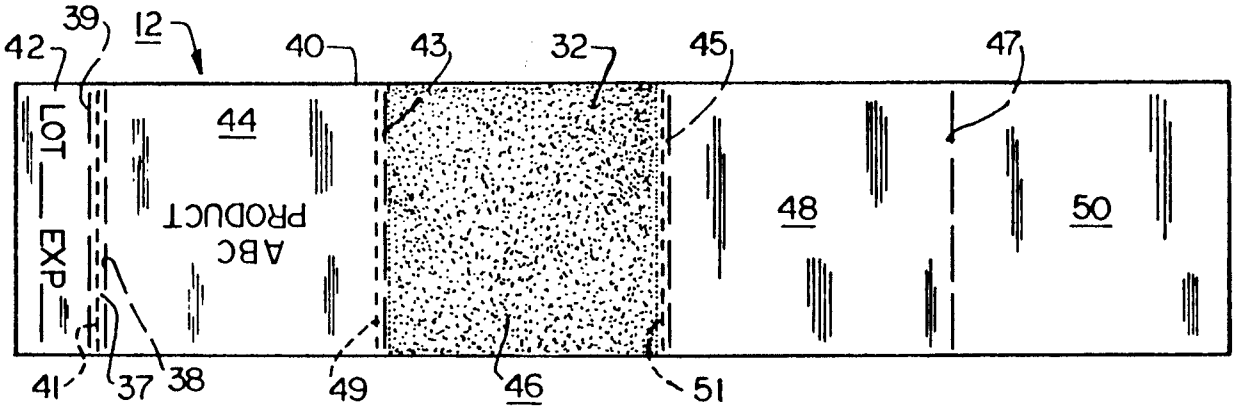
FIG. 5 is a plan view of one side of the label blank prior to its being folded and affixed to the container.
Figure 6:
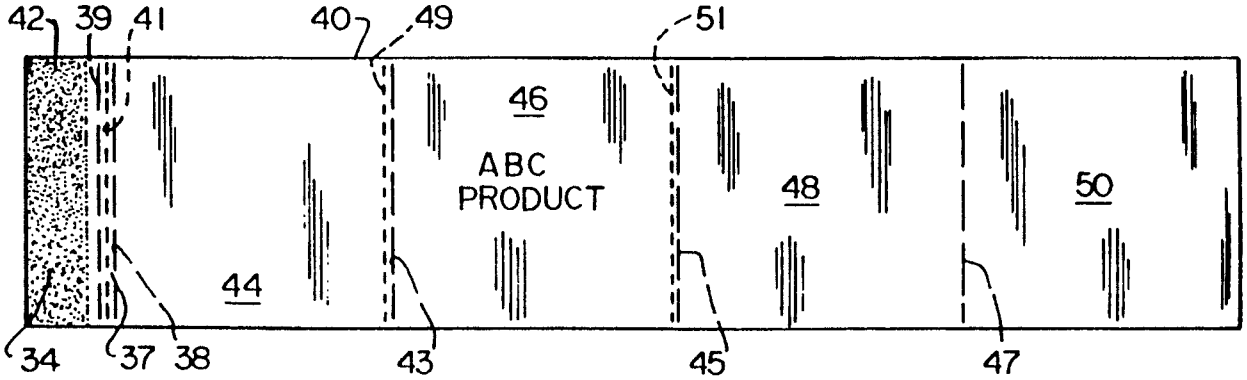
FIG. 6 is a plane view similar to FIG. 5 except showing the other side thereof.

In FIGS. 5 and 6, there is shown the opposing sides of the blank 40 from which label 12 is formed in its open configuration, which comprises a series of panels 42,44,46,48,50. Panels 42,44 together form cover panel 16. Panels 44,46,48,50 are separated by a plurality of fold lines 43,45,47. Panel 46 becomes the bottom panel 14. In FIG. 5, the surface of panel 46 being viewed is the surface which receives the adhesive patch 32. The underside or reverse surface (FIG. 6 of panel 46) is the printed surface which becomes the permanent identifying label when the cover panel and leaflet are removed. It is the surface on which is printed the identifying material. Panel 44, which is immediately adjacent the bottom panel 46 and separated therefrom by fold line 43, becomes the cover panel 16 (FIG. 1). The surface of panels 42,44 illustrated in FIG. 5 are printed with panel 44 becoming the product identifying portion of cover panel 16 and panel 42 becoming the marginal edge are 18 carrying the regulatory information. The rear surface of panel 42 is the surface which ultimately receives adhesive patch 34. As best illustrated in FIG. 6, the bridge area 24 appears as the area 37 between phantom lines 38,39. A first perforated tear line 41 is provided in area 37 to permit subsequent separation of the primary portion of cover panel 14 and marginal edge portion 18. Another or second tear line 49 is provided between panels 44,46 adjacent fold line 43 to permit separation of cover panel 16 from bottom panel 14. Finally, a third tear line 51 is provided between panels 46,48 adjacent fold line 45 to permit separation of leaflet 20 (formed of panels 48,50) from bottom panel 14. It should be understood that, although the adhesive appears in FIGS. 5 and 6 on panels 42,46, preferably the adhesive does not appear on the blank until after the blank is folded and as previously described. Also while panels 48,50 are illustrated to carry literature respecting the product, there may be additional panels attached to panels 48,50 either longitudinally or transversely thereto.

Labels 12, as illustrated in FIG. 4, are printed and folded. They are then temporarily affixed to the silicon release web 30 by adhesive patches 32,34. The adhesive patches may be applied either to the labels or to the release web 30. In either case, the labels 12 are temporarily affixed to the web of release material, which is manufactured, stored and shipped in reels or stacked in a container accordion-style. The pharmaceutical or chemical manufacturer then applied the entire label 12 to containers 10 in the continuous operation (FIG. 1).

The products are then sold to customers who, as described hereinabove, remove the cover panel 16 and the folded leaflet 20 by tearing along the tear lines 41,49 (same as 13 in FIG. 1) and 51. The bottom panel 14 and marginal portion remain with the container 10 and identifies the product, as well as giving statutory material to the doctor, pharmacist or consumer, such as lot number and expiration date.

In addition to providing improved and economically attractive advantages, the label is particularly susceptible to economical automated manufacturing, resulting in great improvement and economy, manufacturing volume, and minimizing wasted paper. Further, it is not necessary to manufacture separately and assemble the folded leaflets to a base label. The entire label is printed, folded, and handled as a unitary item. There is no possibility that the cover panel, leaflet, and bottom panel can be inadvertently mismatched. That is, the leaflet or outer label for one product cannot be affixed to the base label of another product by mistake.

While a preferred embodiment of the invention has been described in detail hereinabove, it is apparent that various changes might be made without departing from the scope of the invention as set forth in the claims below.

What is claimed is:

1. A label blank for forming a unitary label, said label blank comprising a cover panel having a primary portion carrying printed indicia for displaying identifying information and a marginal edge area on an extended flap having printed indicia on an upper surface thereof for displaying statutory information; a bottom panel formed integrally with said primary portion of said cover panel and connected thereto along a fold line, said bottom panel having printed indicia on an upper surface thereof for displaying identifying information and having a patch of adhesive applied to an undersurface thereof for securing said bottom panel to a package; an undersurface of said marginal edge area also having a patch of adhesive applied thereto; a third panel adjacent said first panel and connected along a fold line thereto, said third and subsequent panels being separable from said bottom panel by a tear line; said top panel being separable from said bottom panel by another tear line; said marginal edge portion being separable from said cover panel by yet another tear line.

2. The label blank according to claim 1 wherein said printed indicia on said cover panel and said printed indicia on said bottom panel carries substantially the same identifying matter.

3. A roll of labels comprising:

a) a strip of silicon release paper;

b) a plurality of unitary labels temporarily affixed to said silicon release web, each of said unitary labels comprising a cover panel having a primary portion carrying printed indicia for displaying identifying information and a marginal edge area on an extended flap having printed indicia on an upper surface thereof for displaying statutory information; a bottom panel formed integrally with said primary portion of said cover panel and connected thereto along a fold line, said bottom panel having printed indicia on an upper surface thereof for displaying identifying information and having a patch of adhesive applied to an undersurface thereof for securing said bottom panel to a package; an undersurface of said marginal edge area also having a patch of adhesive applied thereto; a folded leaflet formed integrally with said bottom panel and connected along a fold line to said bottom panel, said folded leaflet and said primary portion of said cover panel being separable from said bottom panel and said marginal edge portion by tear lines therebetween, said marginal edge portion extending outwardly beyond said bottom panel and said folded leaflet and carrying printed indicia for displaying statutory information.

4. A unitary label of the type including a front panel on which can be printed product identifying matter as well as such statutory material as the lot number and/or manufacturing date, and a folded instruction leaflet on which can be imprinted information concerning the content and use of the product, said label construction comprising:

a) a paper blank having a front face and a rear face, the paper blank divided into a plurality of panels defined by fold lines;

b) said plurality of panels including:

i) a first or bottom panel having a non-adhesive surface forming a portion of the rear face of the paper blank, wherein the non-adhesive surface of the first panel has a first predetermined identifying printed indicia thereon and the first panel also having an opposite surface forming a portion of the front face of the paper blank, wherein the opposite surface has adhesive applied thereto;

ii) a second or front panel adjacent said first panel and having a second predetermined printed indicia on a primary portion of a surface forming a portion of the rear face of the paper blank;

iii) said front panel also including an extended flap forming a marginal edge portion thereon; said marginal edge portion carrying printed indicia for displaying regulatory information on a surface forming a portion of the rear face of the paper blank, an opposite side of said marginal edge portion forming a portion of the front face of the paper blank and having adhesive applied thereto;

iv) a first tear line extending parallel to and adjacent a fold line between said first and second panels, and a second tear line extending through the portion of said front panel between said primary portion and said marginal edge portion;

v) a third panel adjacent said first panel and folded between said first and second panels, and a third tear line extending parallel to and adjacent a fold line between said first and third panels;

vi) a plurality of further panels attached to said third panel and folded together and positioned between said first and second panels to form said folded instruction leaflet;

c) said paper blank being folded along said fold lines into said unitary label;

d) whereby said label may be applied as a unit to a product by affixing the adhesive surface of said bottom panel and the adhesive side of said marginal edge portion of said front panel to said product, whereupon the primary portion of said front panel and the instruction leaflet may be torn along said tear lines and removed from the bottom panel and from said marginal edge portions, with the bottom panel and marginal edge portion remaining affixed to said product for identification thereof and for permanent provision of the regulatory information.

5. The label construction according to claim 4 wherein the printed indicia of said bottom panel and the primary portion of the front panel carry substantially the same identifying matter.

6. The label construction according to claim 4 wherein said plurality of further panels are folded together as a flattened spiral.

7. The label construction according to claim 4 wherein each of said third and successive panels are slightly shorter in length than the previous panels.

8. A unitary label comprising a cover panel having a primary portion carrying printed indicia for displaying identifying information and a marginal edge area on an extended flap having printed indicia on an upper surface thereof for displaying statutory information; a bottom panel formed integrally with said primary portion of said cover panel and connected thereto along a fold line, said bottom panel having printed indicia on an upper surface thereof for displaying identifying information and having a patch of adhesive applied to an undersurface thereof for securing said bottom panel to a package; an undersurface of said marginal edge area also having a patch of adhesive applied thereto; a folded leaflet formed integrally with said bottom panel and connected along a fold line to said bottom panel, said folded leaflet and said primary portion of said cover panel being separable from said bottom panel and said marginal edge portion by tear lines therebetween, said marginal edge portion extending outwardly beyond said bottom panel and said folded leaflet and carrying printed indicia for displaying statutory information.

9. The unitary label according to claim 8 wherein said patch of adhesive beneath said bottom panel and said patch of adhesive beneath said marginal edge portion are separated, and a bridge portion of said extended flap of said cover panel between said primary portion and said marginal edge portion overlies said space between said adhesive patches and contains a tear line for separating said primary portion and said marginal edge portion.

10. The label according to claim 8 wherein the printed indicia of said bottom panel and the printed indicia of said primary portion of said cover panel carry substantially the same identifying matter.

11. A unitary label of the type including a front panel on which can be printed product identifying matter as well as such statutory material as the lot number and/or manufacturing date, and a folded instruction leaflet on which can be imprinted information concerning the content and use of the product, said label construction comprising:

a) a paper blank having a front side and an opposing rear side, the paper blank divided into a plurality of panels defined by fold lines, each of the panels having a front face forming a portion of the front side of the paper blank and a rear face forming a portion of the rear side of the paper blank;

b) said plurality of panels including:

i) a first panel including a non-adhesive surface on the front face of the first panel with a first predetermined printed indicia thereon, and wherein an adhesive is applied to the rear face of the first panel;

ii) a second panel adjacent said first panel and having a primary portion and a marginal edge portion forming an extended flap, the primary portion having a second predetermined printed indicia displayed on the rear face of the second panel, and the marginal edge portion having an adhesive applied to the front face of the second panel;

iii) a first tear line disposed between the first and second panels for separating the first and second panels, and a second tear line disposed adjacent said extended flap for separating the extended flap from the second panel;

iv) a third panel adjacent said first panel;

v) a third tear line disposed between said first and third panels for separating said first and third panels;

vi) at least one further panel attached to said third panel to form together with said third panel the instruction leaflet;

c) said paper blank being folded along said fold lines into said unitary label.

12. The label according to claim 11 wherein the marginal edge portion has a predetermined printed indicia displayed on the rear face of the second panel.

13. The label construction according to claim 12 wherein the label is positioned on a container for use, wherein the rear face of the first panel is adhered to the product and the third panel and plurality of further panels are disposed between said first and second panels such that panels form a stack, wherein the second panel forms a top cover panel with the marginal edge portion extending beyond the stack of panels and the adhesive of the marginal edge portion securing to the container such that the second panel overlies and secures the leaflet to the container, and whereby the primary portion of said front panel and the instruction leaflet may be torn along tear lines and removed from the bottom panel and from said marginal edge portions, with the bottom panel and marginal edge portion remaining affixed to said product for identification thereof and for permanent provision of the regulatory information.

14. The label construction according to claim 11 wherein the printed indicia of said first panel and the printed indicia of said primary portion of the second panel carry substantially the same identifying matter.

15. The label construction according to claim 13 wherein said plurality of further panels are folded together as a flattened spiral.

16. The label construction according to claim 11 wherein each of said third and further panels are slightly shorter in length than the previous panels.

17. A label blank used in the production of folded unitary labels of the type including a front panel on which can be printed product identifying matter as well as statutory material such as the lot number and/or manufacturing date, and a folded instruction leaflet on which can be imprinted information concerning the content and use of the product, said label blank comprising:

a) a paper blank having a front face and a rear face, the paper blank divided into a plurality of panels defined by fold lines;

b) said plurality of panels including:

i) a first or bottom panel having a non-adhesive surface forming a portion of the rear surface of the paper blank, wherein the non-adhesive surface of the first panel has a first predetermined identifying printed indicia thereon and the first panel also having an opposite surface forming a portion of the front face of the paper blank, wherein the opposite surface has adhesive applied thereto;

(ii) a second or front panel adjacent said first panel and having a second predetermined printed indicia on a primary portion of a surface forming a portion of the rear face of said paper blank;

(iii) said front panel also including an extended flap forming a marginal edge portion thereon; said marginal edge portion carrying printed indicia for displaying regulatory information on a surface forming a portion of the rear face of the paper blank, an opposite side of said marginal edge portion forming a portion of the front face of the paper blank and having adhesive applied thereto;

(iv) a first tear line extending parallel to and adjacent the fold line between said first and second panels, and a second tear line extending through the portion of said front panel between said primary portion and said marginal edge portion;

(v) a third panel adjacent said first panel and folded between said first and second panels, and a third tear line extending parallel to and adjacent the fold line between said first and second panels; and (vi) a plurality of further panels attached to said third panel and folded together and positioned between said first and second panels to form, when folded, said folded instruction leaflet.

18. The label blank according to claim 17 wherein said first predetermined identifying printed indicia on said bottom panel and the second predetermined printed indicia on the primary portion of said front panel carry substantially the same identifying matter.

* * * * *